US007223345B2

(12) United States Patent
Franzreb et al.

(10) Patent No.: US 7,223,345 B2
(45) Date of Patent: May 29, 2007

(54) HIGH-GRADIENT MAGNETIC FILTER AND METHOD FOR THE SEPARATION OF WEAKLY MAGNETISABLE PARTICLES FROM FLUID MEDIA

(75) Inventors: Matthias Franzreb, Karlsruhe (DE); Harald Leinen, Pulheim (DE); Götz Warlitz, Elsdorf (DE)

(73) Assignee: Steinert Electromagnetbau GmbH, Cologne (DE)

( * ) Notice: Subject to any disclaimer, the term of this patent is extended or adjusted under 35 U.S.C. 154(b) by 511 days.

(21) Appl. No.: 10/473,714

(22) PCT Filed: Apr. 4, 2002

(86) PCT No.: PCT/DE02/01225

§ 371 (c)(1),
(2), (4) Date: Mar. 18, 2004

(87) PCT Pub. No.: WO02/081092

PCT Pub. Date: Oct. 17, 2002

(65) Prior Publication Data

US 2004/0159612 A1 Aug. 19, 2004

(30) Foreign Application Priority Data

Apr. 9, 2001 (DE) ..... 101 17 659

(51) Int. Cl.
*B03C 1/033* (2006.01)

(52) U.S. Cl. ..... 210/695; 210/791; 210/222; 210/223; 210/391; 210/411; 209/217; 209/223.2

(58) Field of Classification Search ..... 210/695, 210/791, 222, 223, 391, 411; 209/217, 223.2
See application file for complete search history.

(56) References Cited

FOREIGN PATENT DOCUMENTS

DE 904 041 C 2/1954

(Continued)

OTHER PUBLICATIONS

Watson J H P et al.: "Magnetic Separation using a Switchable System of Permanent Magnets (Abstract)" Journal of Applied Physics, American Institute of Physics. New York; vol. 81, No. 8, part 2A, Apr. 15, 1997, p. 4259.

*Primary Examiner*—David A. Reifsnyder
(74) *Attorney, Agent, or Firm*—Christa Hildebrand; Norris McLaughlin & Marcus, PA

(57) ABSTRACT

High-gradient magnetic filter and method for the separation of weakly magnetisable particles from fluid media (2) in a circuit, embodied as a compact, low-maintenance unit with low repair requirements, comprising a housing (1), for the high gradient magnetic filter, with means for directing the flowing medium (2) in a pipe system with a feed (3) and return (4), a magnetic circuit (5), forming the high-gradient magnet filter in which at least one filter (8) is arranged in a filter chamber (7), formed between the pole faces (6) of the magnetic circuit (5), through which the medium (2) for purification flows, at least one permanent magnet (9), arranged in the magnetic circuit (5), for generation of a magnetic field between the pole faces (6). The magnetic circuit (5) is separated and sealed off from the flowing medium, the magnetic field between the pole faces (6) may be alternately switched on and off by means of the permanent magnet (9), whereupon the discharge and the operation of separating off the particles from the flowing medium may be achieved simply and economically.

34 Claims, 3 Drawing Sheets

FOREIGN PATENT DOCUMENTS

| | | | |
|---|---|---|---|
| DE | 11 77 091 | B | 9/1964 |
| DE | 33 12 207 | A1 | 10/1984 |
| DE | 43 14 902 | C2 | 11/1994 |
| DE | 690 17 401 | T2 | 7/1995 |
| DE | 196 26 999 | C1 | 8/1997 |
| DE | 297 23 852 | U1 | 12/1997 |
| EP | 0 434 556 | A | 6/1991 |
| FR | 2 544 224 | | 10/1984 |
| GB | 796 336 | A | 6/1958 |
| WO | WO 01/97693 | A1 | 12/2001 |

HIGH-GRADIENT MAGNETIC FILTER AND METHOD FOR THE SEPARATION OF WEAKLY MAGNETISABLE PARTICLES FROM FLUID MEDIA

BACKGROUND OF THE INVENTION

The invention relates to a high-gradient magnetic filter for separating weakly magnetizable particles from fluid media, with the operating mode derived from the physical principle of generating field strength gradients by introducing a ferromagnetic structure into a magnetic field. The invention also relates to a method for operating the high-gradient magnetic filter.

Such filters predominantly generate the required magnetic field using permanent magnets, so that the components can be manufactured more compact and at lower cost, as well as operated more energy-efficient than filters using electromagnets.

DESCRIPTION OF THE RELATED ART

A device of this type has been described in DE 33 12 207 A1. The device includes stationary chambers that are filled with a magnetizable ferromagnetic filling material. Fittings are provided for feeding and discharging a fluid medium. Each pair of the chambers has a common magnetization arrangement, whose magnetic conductors includes two opposing elements that are arranged on different sides of a line extending through the centers of these chambers. Each of these elements includes a magnet with pole faces which are arranged on the chambers in diametrically opposed disposition in a direction perpendicular to the line extending through the centers of the chambers, whereby these two elements together with the ferromagnetic filling material form a closed magnetic circuit.

Disadvantageously, the device takes up considerable space and employs a complex process for separating the ferromagnetic substances from the fluid media.

DE 196 26 999 also discloses a high-gradient magnetic separator with a magnetic unit having two poles that together form a gap in which a homogeneous magnetic field can be generated, with a matrix frame that can be rotated about an axis and at least partially surrounds an annular interior space that is divided by partition walls into segments, as well as at least one feed and return line. It is an object of that invention to lengthen the path of the fluid within the magnetic field. This is solved in that the width of the magnetic unit along the interior space corresponds at least to the width of two segments and that each segment of the annular interior space is connected in the gap region with its adjoining segments through a respective opening, whereby the openings are located alternatingly at a first and a second location, wherein in the second location does not face the first location.

The magnetic field is herein also produced by permanent magnets, enabling a more compact design of the separator while lowering its manufacturing as well as operating costs.

Disadvantageously, the permanent magnets of this device cannot be switched off for the required backwashing operation. The filter chambers arranged in a carousel are therefore cyclically rotated out of the region of the magnetic field following the filtering operation, which takes place inside the magnetic field, and flushed in the field-free zone. Thereafter, the filter chambers are again rotated into the magnetic field and exposed to the fluid to be cleaned, until the filter is loaded and has to be backwashed again outside the magnetic field.

A carousel separator of this type is necessarily constructed with a large number of movable parts and, more particularly, numerous seals. This causes wear and leaks and can hence result in significant maintenance and repair costs which cannot be justified, for example, in a communal wastewater plant.

At least the problem caused by seals is solved by another high-gradient magnetic separator described in DE-GM 297 23 852.3. The individual filter chambers are here not moved in and out of the magnetic field. The filter system is stationary, and a magnet is mechanically moved back and forth for initiating the filtering process and backwashing. However, a large number of movable parts is still required.

Finally, a recently developed high-gradient magnetic separator, as described in WO01/07167 A1, is unsuitable for the problem to be solved, since it uses a different design and a different separation principle for the separation.

SUMMARY OF THE INVENTION

It is an object of the invention to provide a high-gradient magnetic filter for separating weakly magnetizable particles from fluid media, which—through the use of a permanent magnet for generating the magnetic field—represents a compact unit that can be easily maintained and repaired, which simplifies the process for separating the particles and renders the permanent magnet ineffective in the required backwash operation. The variety and number of components should also be reduced and the sealing problem eliminated. The method of the invention for operating the high-gradient magnetic filter should ensure an efficient use of the filter.

The object is solved with the invention according to claim 1 in that the high-gradient magnetic filter includes

- a housing receiving the high-gradient magnetic filter with means for directing the fluid media in a pipe system with a feed and a return,
- a magnetic circuit forming the actual high-gradient magnetic filter, with a filter disposed in a filter chamber that is formed between pole faces of the magnetic circuit, with the medium to be cleaned flowing through the filter,
- at least one permanent magnet arranged in the magnetic circuit for generating the magnetic field between the pole faces, whereby this section of the magnetic circuit is separated from the fluid medium and therefore sealed, and
- the magnetic field between the pole faces which can be switched off and switched on again by the permanent magnet.

According to one alternative embodiment, the permanent magnet is formed as a rotor and rotatably arranged in the correspondingly formed section of the magnetic circuit. The rotation angle of the rotor can be adjusted so that the field strength between the pole faces can be selected between a minimum and a maximum field strength value, so as to adapt the field strength to the different materials of the particles to be separated. It is also possible to lock the angular position of the rotor, for example, in steps of 90° or in steps having other angles.

According to the other alternative embodiment of the invention, the permanent magnet is formed as a linearly displaceable element in the correspondingly formed section of the magnetic circuit.

According to the method the invention for the operating the high-gradient magnetic filter, the weakly magnetizable particles are separated from the fluid medium alternatingly in the pipe system essentially according to the following steps:

a) applying the fluid medium to be separated to the filter via the pipe system having a feed and a return while the magnetic field in the magnetic circuit between the pole faces is switched on, with the magnetic field penetrating the filter chamber of the filter containing the flowing medium, wherein the magnetic particles settle down on the filter due to the high field gradients, with the field strength being adjustable to different values that correspond to the angular position of the permanent magnet, thereafter
b) switching off the magnetic field of the permanent magnet and removing the settled and separated particles from the filter in a flushing process implemented as a counter-flow or also a co-flow process, and
c) repeating the step sequence a) and b) until the separation of the particles from the fluid medium is concluded.

Moreover, the method can also be operated efficiently by using a program for controlling the cycles of the fed and returned medium and/or flushing medium in cooperation with the magnetic field, which is to be switched on and off, and the magnetic field strength to be set, whereby the program also includes the functions of the features.

The invention will be described with reference to exemplary embodiments.

DESCRIPTION OF THE PRESENTLY PREFERRED EMBODIMENTS

Figure 1:
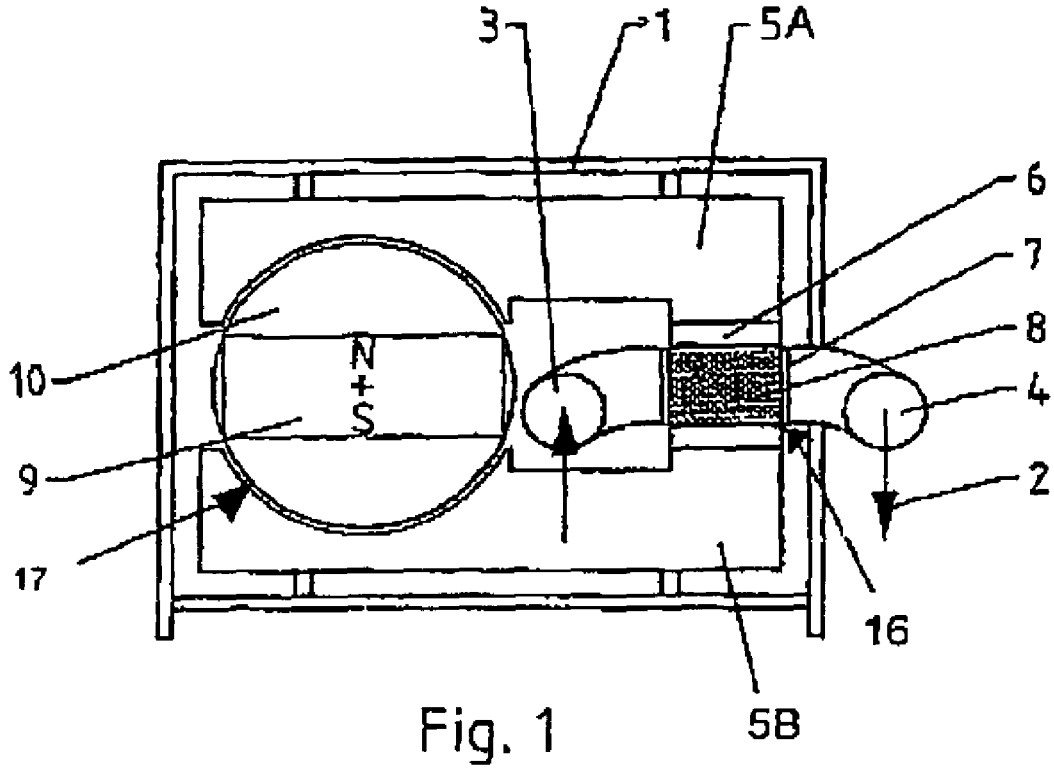
FIG. 1 is a simplified diagram of the high-gradient magnetic filter in a state switched on by the rotor 10.
Figure 2:
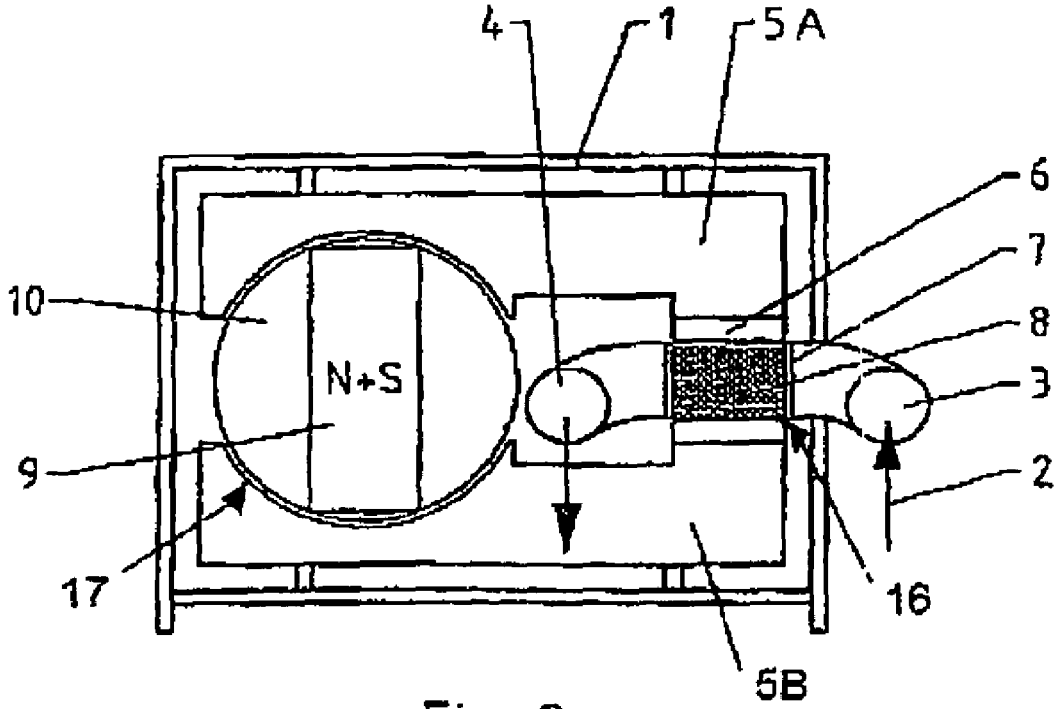
FIG. 2 shows the high-gradient magnetic filter of FIG. 1 in a switched-off state.

As shown in FIGS. 1 and 2, the high-gradient magnetic filter according to the invention is essentially constructed of a housing 1 with a pipe system having a feed 3 and a return 4 for directing a fluid medium 2 (arrows), from which weakly magnetizable particles are to be separated. Other means (not shown) are used for this purpose, such as, for example, conventional valve control blocks that control the corresponding feed 3 and return 4 of the medium 2 in alternating circulation directions.

A magnetic circuit 5 is disposed inside the housing 1. The magnetic circuit 5 is composed of two spaced flux conducting sections 5*b*, 5*b* forming at least two pole gaps 16, 17 therebetween. A filter 8, through which the medium 2 flows, is disposed in a filter chamber 7 formed between pole faces 6 of the magnetic circuit 5. A permanent magnet 9 is arranged in the magnetic circuit, which produces in a switched-on state, shown in FIG. 1, between the pole faces 6 a magnetic field that extends through the filter 8.

The entire section of the magnetic circuit 5 is always separated from the fluid medium 2 and therefore sealed, whereby the pipe system with the feed 3 and return 4 is surrounded by the magnetic circuit 5 in a compact manner.

Figure 4:
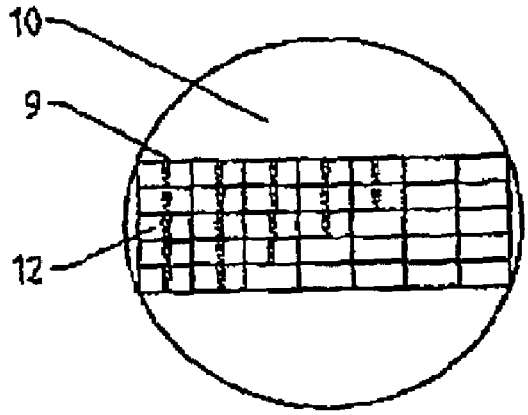
FIG. 4 is a schematic diagram of the rotor 10 with the permanent magnet 9 composed of individual permanent magnets 12.
Figure 5:
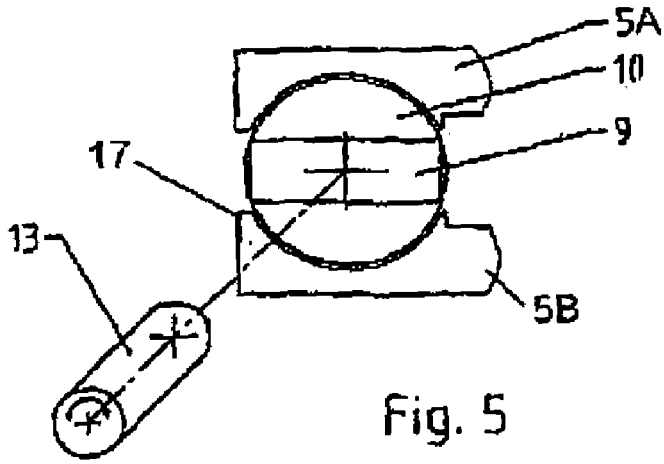
FIG. 5 is a schematic diagram of the rotor 10 with a drive 13.
Figure 6:
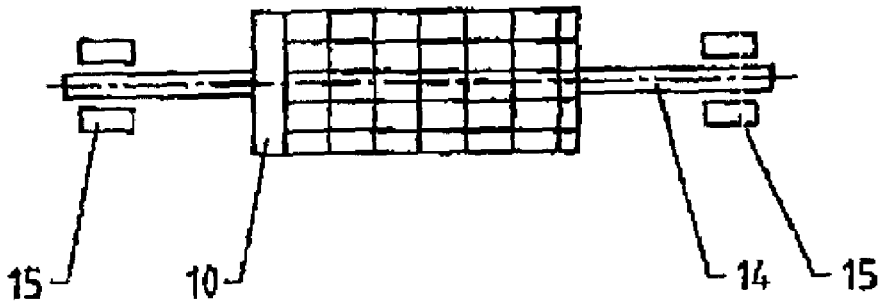
FIG. 6 shows schematically the support of the rotor 10.

FIGS. 1 and 2 shows the alternative embodiment of the invention with a permanent magnet 9 formed as a rotor 10. The rotor 10 is provided with individual permanent magnets 12, as shown in FIG. 4. FIG. 5 shows schematically a drive 13 for the rotor 10, with the drive 13 being used to switch the magnetic field off (FIG. 2) and on (FIG. 1). Advantageously, the rotor 10 is provided with an axle 14 which is slidably and rotatably received in bearings 15 (FIG. 6).

Figure 3:
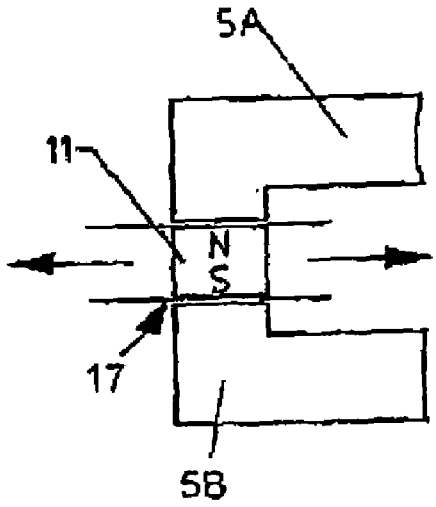
FIG. 3 is a schematic diagram of the alternative embodiment of the invention with the permanent magnet 9 embodied as a linearly displaceable element 11.

FIG. 3 shows schematically the alternative embodiment of the invention with the permanent magnet 9 implemented as linearly displaceable, for example slidably supported, element 11 which switches the magnetic field on and off with the help of a drive (not shown). This high-gradient magnetic filter is constructed similarly to the filter depicted in FIGS. 1 and 2.

Advantageous embodiments of this basic construction are feasible which can be implemented depending on their intended application and desired efficiency, and which can be described as follows:

Depending on the characteristic properties of the weakly magnetizable particles to be separated from the fluid medium 2, the rotation angle of the rotor 10 can be adjusted so that the effective field strength between the pole faces 6 can be selected between a minimum and a maximum field strength value. In this way, the field strength to which the different materials of the particles are subjected can be adjusted so as to affect the separation effect. Advantageously, the rotor 10 can also be rotated and locked in steps of 90° or in steps having other angles.

Figure 7:
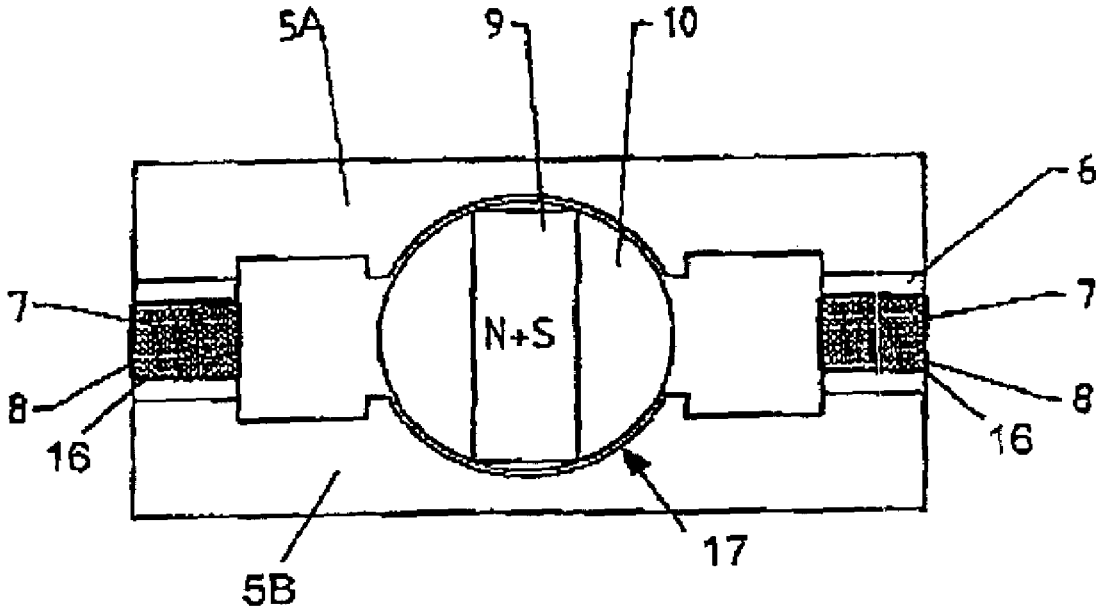
FIG. 7 shows schematically a dual configuration according to the invention with two filters 8 and a rotor 10.

To increase the throughput and efficiency of the high-gradient magnetic filters according to the invention and to reduce their complexity, the embodiment depicted in FIG. 7 is proposed whereby the magnetic circuit 5 is implemented using two filters 8 and whereby a magnetic field produced by a permanent magnet 9 can in a switched-on state be applied simultaneously to each of the two filters 8 or switched off. FIG. 7 shows the permanent magnet 9 in form of a rotor 10, whereby the throughput and efficiency can also be increased by the linearly displaceable element 11 implemented as a permanent magnet 9, if the element 11 is compatible in a likewise configured and/or arranged magnetic circuit 5 and applies a magnetic field to at least two filters 8.

The method of the invention for operating all the feasible alternative embodiments provides that separating the weakly magnetizable particles from the fluid medium 2 proceeds alternatingly in the pipe system according to the following steps:

a) In the first step sequence, the fluid medium to be separated is applied to at least one filter 8 via the pipe system. The pipe system can be alternatingly applied to a feed 3 and a return 4, wherein in this first step sequence, for example, FIG. 1 depicts the feed 3 and return 4 of the fluid medium 2 to be cleaned, with the magnetic field in the magnetic circuit 5 between the pole faces 6 being switched on. The magnetic field penetrates the filter 8 through which the medium 2 flows via the pipe system. The filter 8 consists, for example, of a magnetizable wire mesh. Due to the high field gradients at the filter 8, the magnetic particles settle down on the wire mesh. The field strength can be set to different values according to the rotation (rotor 10) or displacement (linearly displaceable element 11) of the permanent magnet 9.

b) In the following step sequence, the magnetic field of the permanent magnet 9 (rotor 10/linearly displaceable element 11) is switched off. The medium (or a medium) 2 with a feed 3 in the opposite direction and return 4 (e.g. corresponding to FIG. 2) removes the separated particles that settled down on the wire mesh of the filter 8 by flushing. Flushing can be carried out in several alternative ways, in that, e.g., a medium 2 to be cleaned or from which particles are to be removed is used as a flushing medium, or a separate medium 2 is used as a flushing medium by suitably directing the medium 2 in the pipe system through valve controls disposed in the feed 3 and return 4.

c) Repeating the aforedescribed sequential steps continuously with circulation in opposite directions, whereby the filter 8 can be removed from the filter chamber 7 or exchanged depending on its condition or use, for example to replace the filter 8.

Both alternatives can be implemented in a counter-flow in a co-flow configuration.

By using a program the cycles of the forward and backward moving medium 2 and/or the flushing medium in the alternating circulation can be controlled for all alternative embodiments of the device and method in conjunction with the magnetic field, which is to be switched on and off, and the magnetic field strength to be set.

INDUSTRIAL APPLICABILITY

The industrial applicability of the concept for the device and method is distinguished in that on one hand, a compact unit requiring little maintenance and few repairs can be provided that has interchangeable assemblies for easy maintenance, and on the other hand, the process and operation of the separation of the particles from fluid medium can be performed easily and cost-effectively, whereby finally the aforedescribed disadvantages of the state of the art are successfully overcome so that many different and significant industrial applications become possible.

The invention claimed is:

1. A high-gradient magnetic filter for separating weakly magnetizable particles from a circulating fluid medium, comprising a housing adapted to receive a pipe system with a feed and a return, a magnetic circuit disposed in the housing and having two magnetic flux conducting sections which form at least two pole gaps therebetween, a permanent magnet arranged in a first of the at least two pole gaps of the magnetic circuit for generating a magnetic field in another of the at least two pole gaps, said permanent magnet movable between an ON-position and an OFF-position, at least one filter chamber disposed in the pipe system and including a filter element, said filter element located in the other of the at least two pole gaps, and means for directing the fluid medium inside the pipe system through the filter chamber in two opposing flow directions, wherein the magnetic circuit is located external to the pipe system and sealed against the circulating fluid medium, and wherein a high magnetic field gradient is applied across the at least one filter when the permanent magnet is in the ON-position, and the magnetic field across the filter is a remanent magnetic field when the permanent magnet is in the OFF-position.

2. The high-gradient magnetic filter according to claim 1, wherein the medium is supplied on both sides and over the entire length of the filter, and wherein the pipe system is a closed pipe system.

3. The high-gradient magnetic filter according to claim 1, wherein the length of the filter is less than or equal to the length of pole faces forming the other of the at least two pole gaps.

4. The high-gradient magnetic filter according to claim 3, wherein the filter chamber has connections for the filter such that the medium flows uniformly through the filter.

5. The high-gradient magnetic filter according to claim 1, wherein the housing is configured as a frame for receiving an assembly with the magnetic circuit and for receiving an assembly with the pipe system.

6. The high-gradient magnetic filter according to claim 1, wherein the permanent magnet is formed as a rotor and rotatably arranged in the first pole gap of the magnetic circuit.

7. The high-gradient magnetic filter according to claim 6, wherein a rotation angle of the rotor is adapted to be set between a minimum and a maximum field strength value.

8. The high-gradient magnetic filter according to claim 7, wherein the rotation angle of the rotor is adjustable in 90° steps.

9. The high-gradient magnetic filter according to claim 6, wherein the rotor includes an axle and wherein the axle is supported in bearings.

10. The high-gradient magnetic filter according to claim 1, wherein the permanent magnet is formed as a linearly displaceable element in the first pole gap of the magnetic circuit.

11. The high-gradient magnetic filter according to claim 10, wherein the linearly displaceable element is supported.

12. The high-gradient magnetic filter according to claim 1, comprising a configuration of the magnetic circuit with at least two filters, wherein the permanent magnet switches the at least two filters simultaneously or alternatingly on or off for applying the magnetic field to each of the filters.

13. The high-gradient magnetic filter according to claim 1, wherein the permanent magnet comprises several individual permanent magnets.

14. The high-gradient magnetic filter according to claim 1, wherein the permanent magnet is connected with a drive.

15. The high-gradient magnetic filter according to claim 1, wherein the filter comprises a magnetizable wire mesh or magnetizable steel wool.

16. The high-gradient magnetic filter according to claim 15, wherein the filter can be removed from the filter chamber or exchanged.

17. The high-gradient magnetic filter according to claim 15, wherein for optimizing separation, an interior of the filter is configured so that the medium flowing through the filter passes through the filter with alternating flow directions.

18. The high-gradient magnetic filter according to claim 15, wherein means are provided in the filter to ensure passage of the medium perpendicular or transversely to a total area of the magnetizable wire mesh, the magnetizable steel wool or chips, and longitudinal axes of at least the wires of the wire mesh, steel wool or of the chips, are not oriented in a direction of the magnetic field.

19. The high-gradient magnetic filter according to claim 15, wherein the filter comprises a plurality of individual filters.

20. The high-gradient magnetic filter according to claim 1, wherein the filter is implemented as a cage with magnetizable material enclosed therein, such as wire mesh, steel wool or chips.

21. A method for operating a high-gradient magnetic filter assembly according to claim 1, wherein the separation of the weakly magnetizable particles from the fluid medium proceeds alternatingly in the pipe system according to the following steps:

a) applying the fluid medium to be separated to at least one filter via the pipe system in the feed and the return while the permanent magnetic is in the ON-position causing the magnetic particles to settle down on the filter, with the field strength adjustable to different values according to a rotation or displacement of the permanent magnet thereafter b) switching the permanent magnet to the OFF-position and removing the settled down and separated particles from the filter in a flushing process implemented as a counterflow with the feed and return reversed, and c) repeating the step sequence a) and b) until the separation of the particles from the fluid medium is concluded.

22. The method according to claim 21, wherein the medium, which is to be cleaned and from which the particles are to be removed, is used as a flushing medium.

23. The method according to claim 21, wherein a separate medium is used as a flushing medium.

24. The method according to claim 21, further comprising using a program for controlling cycles of the feed and returned medium or flushing medium in cooperation with the magnetic field to be switched on and off and the magnetic field strength to be set.

25. The method according to claim 24, wherein the cycles are controlled and switched as a function of a time or as a function of a differential pressure.

26. The method according to claim 21, wherein the filter is switched off before reaching its absorbing capacity.

27. The method according to claim 21, wherein at least one of the filters is connected for accumulating the particles and at least one other filter is connected for the flushing process.

28. A method for operating a high-gradient magnetic filter assembly according to claim 1, wherein the separation of the weakly magnetizable particles from the fluid medium proceeds alternatingly in the pipe system according to the following steps:

(a) applying the fluid medium to be separated to at least one filter via the pipe system in the feed and the return while the permanent magnet is in the ON-position causing the magnetic particles to settle down on the filter, with the field strength adjustable to different values according to a rotation or displacement of the permanent magnet, thereafter (b) removing the settled down and separated particles from the filter in a flushing process implemented as a co-flow with the steps of (i) feeding a flushing medium, (ii) returning contaminated flushing medium, and (c) repeating steps a) and b) until the separation of the particles from the fluid medium is concluded.

29. The method according to claim 28, wherein the medium, which is to be cleaned and from which the particles are to be removed, is used as a flushing medium.

30. The method according to claim 28, wherein a separate medium is used as a flushing medium.

31. The method according to claim 28, further comprising the step of using a program for controlling cycles of the feed and returned medium or flushing medium in cooperation with switching the magnetic field on and off and setting the magnetic field strength.

32. The method according to claim 28, wherein the filter is switched off before reaching its absorbing capacity.

33. The method according to claim 28, wherein using a plurality of filters, and connecting at least one of the filters for accumulating particles and connecting at least one other filter for the flushing process.

34. The method according to claim 31, wherein the cycles are controlled and switched as a function of a time or as a function of a differential pressure.

* * * * *